United States Patent [19]

Delvaux et al.

[11] Patent Number: 4,985,164

[45] Date of Patent: Jan. 15, 1991

[54] FORSTERITE AND ITS USE AS INSULATING MATERIAL

[75] Inventors: Pierre Delvaux, Bromptonville; Luc Desrosiers, Rock Forest; Marcel Gouin, Deauville, all of Canada

[73] Assignee: CERAM-SNA Inc., Sherbrooke, Canada

[21] Appl. No.: 246,198

[22] Filed: Sep. 16, 1988

[51] Int. Cl.[5] ..... E04B 1/74

[52] U.S. Cl. ..... 252/62; 428/443; 423/331

[58] Field of Search ..... 252/62; 428/443; 423/331; 106/466; 501/95, 122, 155

[56] References Cited

U.S. PATENT DOCUMENTS 3,387,980 6/1968 Trainor et al. ..... 252/62

3,954,556 5/1976 Jackson et al. ..... 252/62

FOREIGN PATENT DOCUMENTS 2477530 9/1981 France .

OTHER PUBLICATIONS

Kokuritsu Daigaku Kankyo Kagaku Kenkyu Senta Kiyo, 7(1), 61-6 (Japan) 1981.

*Primary Examiner*—Prince E. Willis

*Assistant Examiner*—John F. McNally

*Attorney, Agent, or Firm*—Cushman, Darby & Cushman

[57] ABSTRACT

The present invention relates to a fibrous-like synthetic forsterite obtained by the calcination of chrysotile asbestos fiber at a temperature of from 650° to 1450° C., said synthetic forsterite being characterized by having an $MgO:SiO_2$ ratio lower than 1.1, a raw loose density of from 3 to 40 pcf, a thermal conductivity "k" factor of from 0.25 to 0.40 BTU. In/Hr. ° F. $Ft^2$ and a fusion point of from 1600° to 1700° C. which is useful as an insulating material.

1 Claim, No Drawings

FORSTERITE AND ITS USE AS INSULATING MATERIAL

FIELD OF THE INVENTION

The present invention relates to a fibrous-like synthetic forsterite which is particularly useful as an insulating material and has other industrial uses.

STATE OF THE ART

The use of manufactured or proprietary insulations in building construction or in other items of manufacture requiring to be insulated is well known. It is known that insulation can take various forms such as loose fill insulations, blanket insulations, bolts, structural insulating board, slab or block insulations, reflective insulations and miscellaneous types.

One of the most important classes of insulation is loose fill insulations which are bulk materials which are generally sold in bags and poured in place (or hand-packed) between the structural framing members or mechanically applied by a pneumatic or "blown-in" process, the latter being frequently used in the case of old buildings.

The fibrous type of insulations generally comprises mineral wool such as rock wool, glass wool and slag wool, and organic fibers usually derived from wood.

Rock wool is supplied in the fibrous state as loose wool. Loose rock wool is commonly used for hand-packing and granulated rock wool is poured from the bag between the framing members or pneumatically applied. Glass wool is sold in bags in the natural fibrous state but more usually in bolts or blankets.

Asbestos is another material which has been used for many years as an insulating material in every form. Unfortunately, a general concern for amiantosis and similar respiratory diseases allegedly attributed to asbestos is responsible for a large decline and in some cases, a total ban of the asbestos containing insulating materials.

Accordingly, it would be highly desirable to find a substitute for asbestos as an insulating material which would be devoid of the health drawbacks of asbestos fibers and which would possess highly advantageous insulating qualities.

SUMMARY OF THE INVENTION

In accordance with the present invention, there is now provided a novel insulating material which is a fibrous-like synthetic forsterite product derived by the calcination of chrysotile asbestos fibers having an $MgO:SiO_2$ ratio lower than 1.1 at a temperature of from 650° to 1450° C., said synthetic fosterite being characterized by a raw loose density of from 3 to 40 pounds per cubic foot, a thermal conductivity K factor of from 0.25 to 0.40 BTU. In/Hr.°F.Ft$^2$ and a fusion point of about 1600° to 1700° C.

In accordance with another aspect of the present invention there is provided a novel insulating composition which comprises a mixture of that synthetic forsterite, an inert filler and a binder, said mixture being adapted to be blown on at least one wall of any structure in need to be insulated. Also, such composition can also be moulded in the form of slabs for roof insulation of industrial and commercial buildings.

DETAILED DESCRIPTION OF THE INVENTION

The synthetic forsterite product of the present invention is made by the calcination of chrysotile asbestos fibers of any commercial length at a temperature of from 650° to 1450° C. with a temperature range of from 750° to 950° C. being preferred.

The novel synthetic forsterite of the present invention has unexpected superior insulating properties when compared to granular natural forsterite or synthetic granular forsterite and is devoid of all the undesirable health problems normally associated with chrysotile asbestos fibers.

As starting material, there is used chrysotile asbestos fibers of any commercial grade with short grades being most practical from an economic point of view. The calcination of the chrysotile asbestos fibers is carried by heating to a temperature range of from 650° to 1450° C. The heating is carried either by subjecting chrysotile asbestos fibers to heating in a heating chamber at the selected calcination temperature or by subjecting chrysotile asbestos fibers to gradual heating from room temperature to the desired calcination temperature.

Though the product of the present invention is synthetic fibrous-like forsterite, it has unexpected properties over the granular natural forsterite or synthetic granular forsterite such as density per cubic foot and insulating factor and its physical structure.

Asbestos fibers after their calcination at a temperature of from 650° to 1450° C. still possess a somewhat fibrous structure resembling that of chrysotile asbestos fibers but this fibrous structure of the calcined asbestos fibers disappears upon rough manipulation such as pressure packaging in bags or subjecting to pressure in a mold to form bolts and the like, or when mixing with other materials such as Portland cement where the fibrous structure becomes a powdery material, but the synthetic fibrous-like forsterite still retains its high insulating value.

One of the advantages of synthetic fibrous-like amorphous forsterite is that it can be made available in loose form with densities varying from 3 to 40 pcf depending on the length of the asbestos fibers used or by using varying proportions of different lengths of initial asbestos fibers followed optionally by an adequate mechanical treatment either before or after the calcination treatment.

Table I illustrates the loose density before and after mechanical opening for various grades of fibers and the loose density of synthetic fibrous-like forsterite before and after mechanical treatment.

TABLE I

EXAMPLE OF LOOSE DENSITY OF CHRYSOTILE FIBERS AND SYNTHETIC FIBROUS-LIKE FORSTERITE

| Grades (Quebec standard) | Chrysotile Fiber Loose Density* pcf | Chrysotile Fiber Loose Density** after opening pcf | Synthetic fibrous-like forsterite Loose Density (pcf) without mechanical treatment | Synthetic fibrous-like forsterite Loose Density (pcf) after mechanical treatment |
|---|---|---|---|---|
| 3F | 3.5 | 1.5 | 3 | — |
| 4K | 7.8 | 2.3 | 4 | 12 |

TABLE I-continued

| EXAMPLE OF LOOSE DENSITY OF CHRYSOTILE FIBERS AND SYNTHETIC FIBROUS-LIKE FORSTERITE | | | | |
|---|---|---|---|---|
| | Chrysotile Fiber | | Synthetic fibrous-like forsterite | |
| Grades | | Loose Density** | Loose Density (pcf) | |
| (Quebec standard) | Loose Density* pcf | after opening pcf | without mechanical treatment | after mechanical treatment |
| 5R | 9.6 | 3.4 | 7 | — |
| 6D | 11.9 | 4.6 | 10 | 15 |
| 7D | 12.5 | 10 | 15 | 20–28 |
| 7H | 20–25 | — | 25 | 25–40 |

*Sampling in accordance with procedure A-1-74 of Chrysotile Asbestos Test Manual
**Opening in accordance with procedure F-2-72 of Chrysotile Asbestos Test Manual It will be observed that the loose density after opening of asbestos fibers is always lower than the loose density of the same fiber before opening. On the other hand, it will be noted that the loose density of synthetic fibrous-like forsterite after opening or mechanical treatment is unexpectedly and surprinsingly higher than the loose density of the same synthetic fibrous-like forsterite before opening or mechanical treatment.

Table II illustrates the loose density of synthetic fibrous-like forsterite prepared from mixture of chrysotile fibers of different lengths.

TABLE II

| EXAMPLES OF LOOSE DENSITY OF SYNTHETIC FIBROUS-LIKE FORSTERITE MADE FROM MIXTURES OF CHRYSOTILE FIBERS | | | |
|---|---|---|---|
| Grades | Chrysotile Fiber | | Synthetic fibrous-like forsterite |
| (Quebec standard) | Loose Density | Proportion % | Loose Density (pcf) without mechanical treatment |
| 4K | 3 | 10 | 9 |
| 7D | 10 | 90 | |
| 4K | 3 | 10 | 17 |
| 7H | 20 | 90 | |

Table III illustrates the variations in thermal insulating factor k with the change of density between synthetic fibrous-like and synthetic granular forsterite.

TABLE III

| SYNTHETIC FIBROUS-LIKE FORSTERITE | | SYNTHETIC GRANULAR FORSTERITE | |
|---|---|---|---|
| Density pcf | k BTU.In/ Hr. °F. Ft$^2$ | Density pcf | k BTU.In/ Hr. °F. Ft$^2$ |
| 3 | 0.270 | nil | |
| 10 | 0.300 | nil | |
| 15 | 0.290 | nil | |
| 28 | 0.328 | 100 | 1.1 |

The insulating factor k is the BTU. In/Hr.°F.Ft$^2$. The value of k is determined with a RAPID-K ® apparatus manufactured by the DYRATECH R/D Co. of Cambridge, Mass. The average temperature is 167° F. and the difference of temperature between the cold plate and the warm plate is 50° F.

In conclusion, it will be observed that with synthetic granular forsterite, only one density can be obtained with only one insulating value, although densities of about 100 pcf could be prepared, whereas with synthetic fibrous-like forsterite a selection of densities with corresponding insulating value are possible.

An evaluation of the insulating capacity of various insulating materials was made. This test involved synthetic fibrous-like forsterite having densities of 12, 15, 18, 22 and 28 pcf, synthetic granular forsterite Kaowool ® manufactured by Babcok-Wilcox Co. having densities of 8 and 15 pcf and rockwool having densities of 22, 28 and 33 pcf.

Each material to be tested is placed in a rigid mould of 12"×12"×2". After compressing the material to be tested, a shaped unit is obtained and after removing the bottom of the mould, the sample is placed on an oven to be tested.

The oven is provided with an opening on its top surface, which opening is 8"×8" and comprises a steel trellis work on which each sample to be tested is deposited. A heat source of 1000° C. is located directly under each sample. A thermocouple located on the bottom surface of the sample measures the temperature of the heat source of 1000° C. and the other thermocouples are located on the superior surface of the sample to measure the temperature of the cold surface at different points during a period of 150 minutes. This method allows the measurement of the thermal insulating in relation to different types of insulating material. Results are reported in Table IV.

TABLE IV

| EVOLUTION OF THE TEMPERATURE (®C.) OF THE COLD SURFACE IN RELATION TO TIME - HOT SURFACE 1000° C. | | | | | | | | | | | |
|---|---|---|---|---|---|---|---|---|---|---|---|
| | INSULATING MATERIALS | | | | | | | | | | |
| | SYNTHETIC FIBROUS-LIKE FORSTERITE Density pcf | | | | | SYNTHETIC GRANULAR FORSTERITE Density pcf | KAOWOOL Density pcf | | ROCK WOOL Density pcf | | |
| TIME (min.) | 12 | 15 | 18 | 22 | 28 | 100 | 8 | 15 | 22 | 28 | 33 |
| 5 | 24° C. | 32° C. | 27° C. | 26° C. | 33° C. | 28° C. | 31° C. | 27° C. | 27° C. | 26° C. | 31° C. |
| 15 | 29 | 30 | 30 | 28 | 30 | 30 | 111 | 28 | 28 | 28 | 29 |
| 30 | 67 | 61 | 45 | 37 | 35 | 50 | 149 | 65 | 50 | 33 | 34 |
| 45 | 92 | 88 | 70 | 57 | 44 | 87 | 144 | 88 | 94 | 31 | 45 |
| 60 | 97 | 98 | 84 | 72 | 59 | 111 | 142 | 105 | 111 | 75 | 68 |
| 75 | 100 | 101 | 91 | 82 | 49 | 131 | 132 | 108 | 115 | 91 | 87 |
| 90 | 104 | 104 | 94 | 87 | 80 | 149 | 131 | 103 | 110 | 99 | 93 |
| 105 | 100 | 104 | 96 | 89 | 86 | 155 | 129 | 100 | 111 | 100 | 99 |
| 120 | 101 | 105 | 97 | 89 | 90 | 154 | 130 | 105 | 109 | 103 | 99 |

TABLE IV-continued

| EVOLUTION OF THE TEMPERATURE (®C.) OF THE COLD SURFACE IN RELATION TO TIME - HOT SURFACE 1000° C. | | | | | | | | | | | |
|---|---|---|---|---|---|---|---|---|---|---|---|
| | INSULATING MATERIALS | | | | | | | | | | |
| | SYNTHETIC FIBROUS-LIKE FORSTERITE Density pcf | | | | | SYNTHETIC GRANULAR FORSTERITE Density pcf | KAOWOOL Density pcf | | ROCK WOOL Density pcf | | |
| TIME (min.) | 12 | 15 | 18 | 22 | 28 | 100 | 8 | 15 | 22 | 28 | 33 |
| 135 | 103 | 103 | 95 | 91 | 91 | 160 | 129 | 103 | 117 | 101 | 99 |

It will be noted from Table II that the insulating value of each material increased with the density and that the insulating value of synthetic fibrous-like forsterite is superior to granular forsterite, Kaowool and rockwool. On the other hand, synthetic fibrous-like forsterite is less expensive to prepare than Kaowool or rockwool.

We claim:

1. A fibrous synthetic forsterite obtained by the calcination of chrysotile asbestos fiber at a temperature of from 650° to 1450° C., said synthetic forsterite being characterized by having an $MgO:SiO_2$ ratio lower than 1.1, a raw loose density of from 3 to 40 pcf, a thermal conductivity "k" factor of from 0.25 to 0.40 BTU. In/Hr.°F.Ft$^2$ and a fusion point of from 1600° to 1700° C.

* * * * *